US005138518A

United States Patent [19]

Schmertmann et al.

[11] Patent Number: 5,138,518

[45] Date of Patent: Aug. 11, 1992

[54] METHOD FOR MANUFACTURING A SELECTIVE CALL RECEIVER

[75] Inventors: Neil J. Schmertmann; Michael P. Goldenberg; John P. Cheraso, all of Boynton Beach, Fla.

[73] Assignee: Motorola, Inc., Schaumburg, Ill.

[21] Appl. No.: 574,860

[22] Filed: Aug. 30, 1990

[51] Int. Cl.[5] ..... H01H 9/04; H01H 11/00; G04D 3/00

[52] U.S. Cl. ..... 361/225; 29/179; 29/825; 200/302.1

[58] Field of Search ..... 361/225, 226; 206/301, 206/328; 29/179, 825; 150/154, 165; 200/302.1, 304; 264/39, 229; 368/309, 10–13, 327; 15/151.1, 151.2

[56] References Cited

U.S. PATENT DOCUMENTS

| | | | |
|---|---|---|---|
| 3,902,789 | 9/1975 | Gerritsma et al. | 350/160 LC |
| 4,243,329 | 1/1981 | Nakayama | 368/76 |
| 4,250,572 | 2/1981 | Yoshida | 368/71 |
| 4,459,032 | 7/1984 | Musy | 368/77 |
| 4,562,595 | 12/1985 | Bauer et al. | 455/345 |
| 4,800,543 | 1/1989 | Lyndon-James et al. | 368/10 |
| 5,010,777 | 4/1991 | Yehl et al. | 361/231 |

*Primary Examiner*—A. D. Pellinen
*Assistant Examiner*—Richard T. Elms
*Attorney, Agent, or Firm*—Thomas G. Berry; William E. Koch

[57] ABSTRACT

A housing (18) for an electronic device comprises a chamber (16) having an interior (14) for receiving electronic circuitry and a detachable contaminant barrier (12) generally contouring the interior (14) of the chamber (16) for preventing foreign particles from entering the chamber (16), for removing existing foreign particles in the chamber (16), and for aiding in the handling of the housing (18) during assembly. The detachable contaminant barrier (12) includes a first protrusion (22) for manipulating said contaminant barrier (12) and said housing (18) and a second protrusion (24) for removing said contaminant barrier (12) from said housing (18).

7 Claims, 2 Drawing Sheets

METHOD FOR MANUFACTURING A SELECTIVE CALL RECEIVER

FIELD OF THE INVENTION

This invention relates in general to electronic devices, and more particularly to an apparatus for protecting the housing of an electronic device, the apparatus comprising a contaminant barrier that prevents foreign matter (e.g., dust) intrusion prior to final assembly.

BACKGROUND OF THE INVENTION

Electronic devices are sometimes packaged in plastic, molded housings. These housings may be produced by a private vendor and shipped to a production facility, where the electronic device is assembled. Prior to final assembly, a variety of foreign matter, such as dust and dirt, may enter the housing, resulting in a defect. In the case of a paging device, the housing may include a clear lens for viewing information on a display device; e.g. a liquid crystal display. Prior to the final assembly, the lens usually requires cleaning to remove the foreign material that has accumulated during shipping and handling. The cleaning process is time consuming and frequently results in a permanent defect (i.e. scratches) requiring replacement of the entire lens. Furthermore, the cleaning process cannot easily be performed by robots.

Prior attempts to solve this problem have included placing the housing in a plastic bag. However, the housing is generally removed from the plastic bag prior to placement in a manufacturing environment. In an automated factory, the bag must be removed to enable handling of the housing by robots or other apparatus. Therefore, in both a manual and robotic manufacturing environment, the housing may be exposed to foreign particle intrusion for extended periods of time (e.g., assembly line shutdowns, etc). Therefore, what is needed is a technique for preventing foreign matter intrusion into the housing of an electronic device prior to final assembly.

SUMMARY OF THE INVENTION

In carrying out the invention in one form, there is provided a housing for an electronic device comprising a chamber for receiving electronic circuitry and a detachable contaminant barrier for preventing foreign particles from entering the chamber.

DETAILED DESCRIPTION OF THE INVENTION

Figure 1:
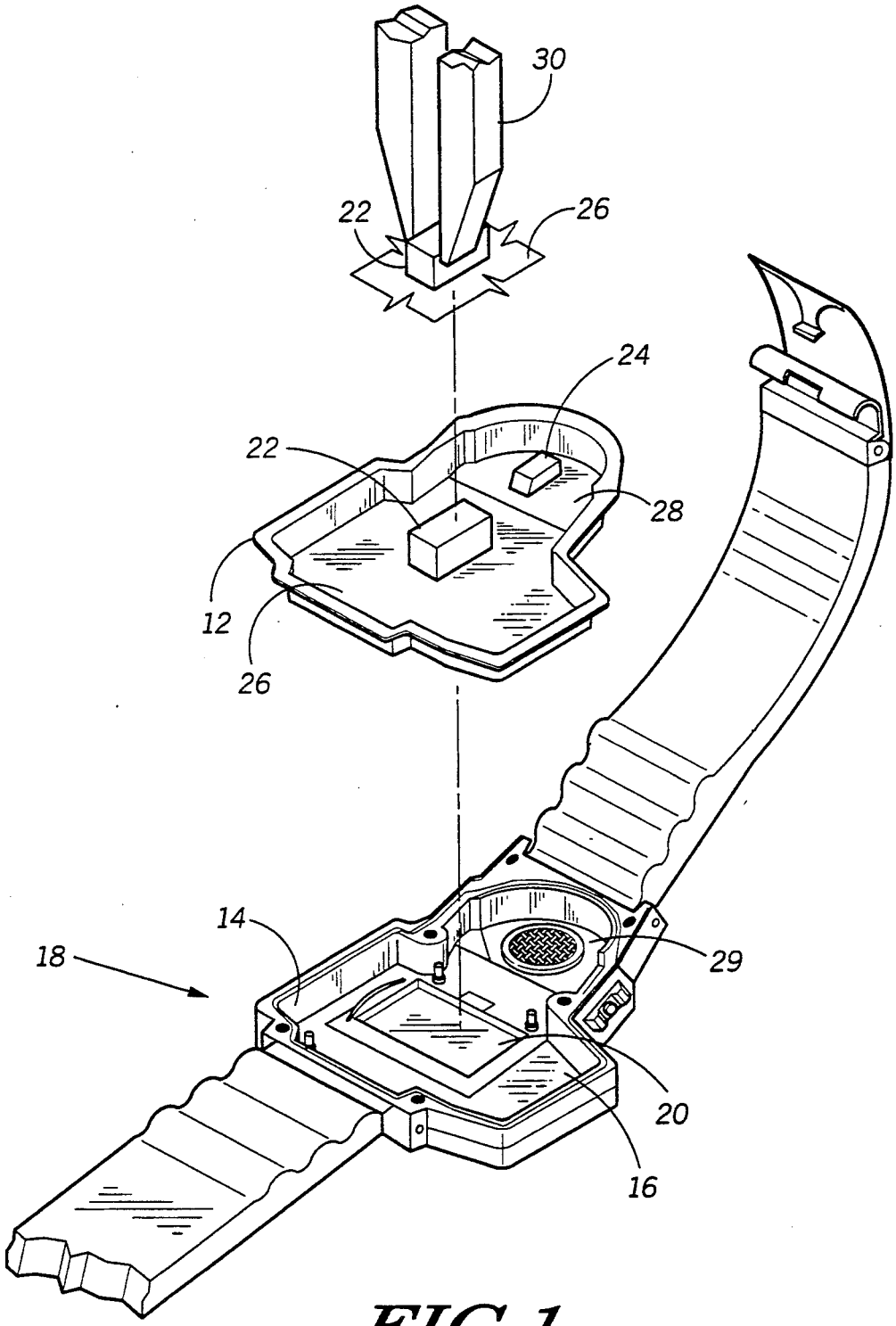
FIG. 1 is a perspective view of the preferred embodiment of the present invention.

Referring to FIG. 1, a contaminant barrier 12 is positioned to engage the interior 14 of a chamber 16 in a housing 18 of an electronic device (e.g., wrist watch selective call receiver). In the preferred embodiment, the contaminant barrier 12 comprises a vacuum formed plastic, such as Mylar manufactured by Dupont, and is approximately 0.015 inches (0.381 mm) in thickness. The contaminant barrier 12 is formed so as to contour the chamber 16, thereby preventing foreign particles from entering the chamber 16 and potentially damaging lens 20.

The contaminant barrier 12 includes two members (i.e. protrusions) 22 and 24 which assist in the manual or automatic (robotic) manipulation and removal of the barrier 12. The first protrusion 22 is positioned substantially in the center of a first surface 26 on the contaminant barrier 12; however, protrusion 22 may be positioned in a variety of locations along the surface 26 without deviating from the intent of the invention. After inserting the contaminant barrier 12 into chamber 16, the first protrusion may be gripped by a tool (e.g., hand-held or robotic end effector) 30. Due to an interference (friction) fit, the contaminant barrier 12 remains engaged with the chamber 16 during manipulation of the first protrusion 22, thereby eliminating the need to hold the electronic device's housing 18 directly. Furthermore, lifting protrusion 22 tends to spread the barrier enhancing the interference or friction fit.

The second protrusion 24 is preferably positioned substantially in the center of a second surface 28 (inclined to match surface 29 of chamber 16) of the contaminant barrier 12. The second protrusion 24 functions as a means for removing the contaminant barrier 12 from the chamber 16. In this case, spreading does not occur. Instead, second surface 28 is peeled from chamber 18. The second protrusion 24 may be positioned in a variety of locations along the second surface 28 without deviating from the intent of the invention. In addition, the shape of the protrusions 22 and 24 are rectangular in the preferred embodiment to enable a standard off-the-shelf robotic end effector to manipulate the barrier 12, however, the shape of the protrusions 22 and 24 may comprise a variety of configurations without deviating from the intent of the invention.

To further protect the interior of the housing 18, the plastic contaminant barrier 12 may be statically charged by conventional techniques using a 5000 volt dc power supply or similar device. Therefore, upon removal, the contaminant barrier will attract foreign matter (e.g., dust) from the lens 20 and interior 14 of the chamber 16 due to the static charge on the barrier 12.

Figure 2:
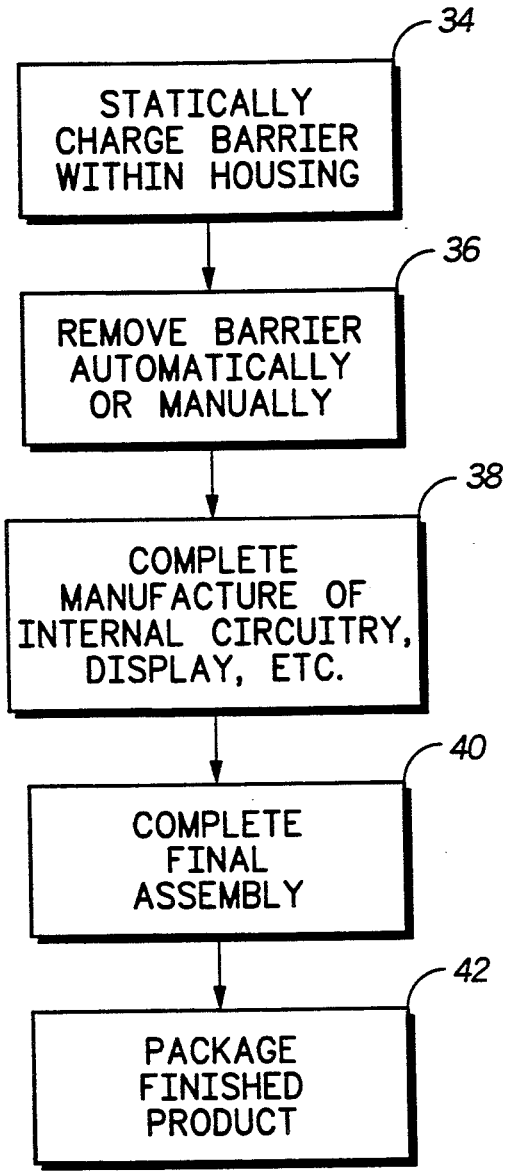
FIG. 2 is a flow chart of the process for manufacturing a selective call receiver incorporating the present invention.

FIG. 2 illustrates generally the process for manufacturing a selective call receiver starting with a housing (18), including a contaminant barrier (12) previously inserted (e.g., preferably by the housing vendor) in the chamber (16) of the housing (18). The contaminant barrier (12) is statically charged by conventional techniques as is shown at 34, while the contaminant barrier (12) is positioned in the chamber (16) of the housing (18) and during its removal from housing (18).

The contaminant barrier (12) is removed from the chamber (16) of the housing (18) either manually or automatically as is shown at 36, thereby removing any foreign matter previously lodged in the chamber (16) prior to insertion of the contaminant barrier (12). The chamber (16) is now ready to receive the display elements, electronic circuitry, and other elements required to produce the desired electronic function as is shown at 38. In the preferred embodiment, the electronic circuitry comprises a selective call receiver. The remaining elements, necessary to complete the selective call receiver, are then assembled during final assembly of the electronic device as is shown at 40. The product is then packaged as is shown at 42 and ready for shipping.

The advantages of using the contaminant barrier include protecting the chamber and lens from damage and foreign contaminants during shipping and handling, aiding manual and/or robotic handling during assembly, and actually removing existing foreign matter from the chamber 16.

We claim:

1. A method for manufacturing a selective call receiver, comprising the steps of:

a) removing a detachable statically charged contaminant barrier from the interior of a housing chamber; and b) installing electronic components necessary to complete said selective call receiver within said housing.

2. The method of claim 1, wherein step a) further comprises the step of removing the detachable statically charged contaminant barrier from the interior of the housing chamber via a robotic assembly procedure.

3. A method for manufacturing a selective call receiver, comprising the steps of:

a) introducing a removable contaminant barrier in the interior of a housing for a selective call receiver;

b) statically charging said contaminant barrier;

c) removing the removable statically charged contaminant barrier from the interior of a housing chamber;

d) installing electronic components necessary to complete said selective call receiver within said housing.

4. The method of claim 3, wherein step c) further comprises the step of removing the detachable statically charged contaminant barrier from the interior of the housing chamber via a robotic assembly procedure.

5. A method for manufacturing a selective call receiver having a display for presenting received messages to a user, comprising the steps of:

a) removing a detachable statically charged contaminant barrier from an interior display area of a housing chamber; and b) installing the display and other electronic components necessary to complete said selective call receiver within said housing.

6. The method of claim 5, wherein step a) further comprises the step of removing the detachable statically charged contaminant barrier from the interior display area of the housing.

7. The method of claim 5, wherein step a) further comprises the step of removing the detachable statically charged contaminant barrier from the interior display area of the housing chamber via a robotic assembly procedure.

* * * * *